US012376636B2

(12) United States Patent
Cooper et al.

(10) Patent No.: US 12,376,636 B2
(45) Date of Patent: Aug. 5, 2025

(54) RECESSED BELT LOOP

(71) Applicant: Amer Sports Canada Inc., North Vancouver (CA)

(72) Inventors: Morgan A. Cooper, Squamish (CA); Erik M. Schwab, Coquitlam (CA)

(73) Assignee: Amer Sports Canada Inc., North Vancouver (CA)

( * ) Notice: Subject to any disclaimer, the term of this patent is extended or adjusted under 35 U.S.C. 154(b) by 145 days.

(21) Appl. No.: 17/988,568

(22) Filed: Nov. 16, 2022

(65) Prior Publication Data

US 2024/0156196 A1 May 16, 2024

(51) Int. Cl.
*A41F 9/00* (2006.01)

(52) U.S. Cl.
CPC ..... *A41F 9/007* (2013.01)

(58) Field of Classification Search
CPC ..... A41F 9/007; A41F 15/02; A41D 2200/10
See application file for complete search history.

(56) References Cited

U.S. PATENT DOCUMENTS 1,504,249 A * 8/1924 Klein ..... A41D 7/00 D2/737
1,611,420 A * 12/1926 Cuddy ..... A41D 13/02 2/70
1,877,697 A * 9/1932 Schlusselberg ..... A41F 9/007 2/93
2,154,329 A * 4/1939 Guillod ..... A41F 15/02 24/561
2,465,374 A * 3/1949 Haman ..... B29C 66/4322 428/104
2,528,854 A * 11/1950 Burk ..... A41F 15/02 24/369
2,643,380 A * 6/1953 Blair ..... A41F 15/02 224/264
2,685,092 A * 8/1954 Singer ..... A41F 9/00 2/227
2,719,303 A * 10/1955 Lodenius ..... A41F 15/02 2/323
2,903,703 A * 9/1959 Blish ..... A41B 3/12 2/137
3,046,991 A * 7/1962 Heberling ..... A41F 15/02 450/86
3,271,783 A * 9/1966 Mallett ..... A41F 9/007 2/236
3,303,515 A * 2/1967 Lash ..... D05B 93/00 112/424
3,789,431 A * 2/1974 Rand ..... A41F 9/007 2/271
4,449,253 A * 5/1984 Hettinger ..... A62B 5/00 5/628
4,599,750 A * 7/1986 Rahaman ..... A41D 27/20 2/243.1
4,668,202 A * 5/1987 Scheurer ..... B63C 9/115 441/116
4,704,745 A * 11/1987 Reaver ..... A41F 15/02 2/268
4,764,988 A * 8/1988 Reaver ..... A41F 15/02 2/268

(Continued)

*Primary Examiner* — Alissa L Hoey
(74) *Attorney, Agent, or Firm* — Terence P. O'Brien; Todd A. Rathe

(57) ABSTRACT

A garment may include a body having a channel and a belt loop extending along and at least partially recessed within the channel.

20 Claims, 11 Drawing Sheets

(56) References Cited

U.S. PATENT DOCUMENTS 5,369,804 A * 12/1994 Metcalf ..... A41D 11/00 2/69
5,542,123 A * 8/1996 DiPietro ..... A41D 11/00 2/69.5
5,935,044 A * 8/1999 Brewster ..... A41F 15/02 450/86
6,135,852 A * 10/2000 Young ..... A41F 15/02 2/268
7,356,850 B2 * 4/2008 Turcotte ..... A41D 13/0007 2/69
7,607,184 B1 * 10/2009 Goodner, Jr. ..... A61G 1/013 2/69.5
7,707,660 B2 * 5/2010 Grilliot ..... A41D 13/0007 2/93
7,779,484 B2 * 8/2010 Fee ..... A62B 17/003 2/69
7,971,273 B2 * 7/2011 Grilliot ..... A62B 17/006 2/81
8,430,204 B1 * 4/2013 Reynolds ..... A62B 35/0006 2/93
8,438,664 B2 * 5/2013 Fee ..... A62B 1/16 2/69
8,656,516 B1 * 2/2014 Reinhardt Rawlings ..... A41D 11/00 2/69
8,679,085 B2 * 3/2014 Ronstrom ..... A61F 13/68 604/397
8,689,712 B2 * 4/2014 Maramotti ..... D06H 5/003 112/475.17
9,015,867 B2 * 4/2015 Kenney ..... A41D 13/0017 2/229
9,675,126 B2 * 6/2017 Allen ..... A41F 9/007
10,660,454 B2 * 5/2020 Fosse ..... A41D 11/00
10,806,200 B2 * 10/2020 Park ..... A41D 1/08
10,820,645 B2 * 11/2020 Lee ..... A41F 9/007
11,071,341 B2 * 7/2021 Stevens ..... A41F 9/002
11,259,574 B1 * 3/2022 Schmidt ..... A41B 1/08
11,375,760 B2 * 7/2022 Rutten ..... A62B 35/0025
11,944,144 B2 * 4/2024 Hogberg ..... A41D 27/20
12,016,409 B2 * 6/2024 Halerz-Sroczynski ..... A41D 27/00
12,070,091 B2 * 8/2024 Rodgers ..... A41F 17/00
2004/0133963 A1 * 7/2004 Jennings ..... A41D 13/1236 2/114
2006/0162050 A1 * 7/2006 Kaufman ..... A41D 27/24 2/244
2009/0000006 A1 * 1/2009 Mitchell ..... A41D 27/28 2/243.1
2011/0197332 A1 * 8/2011 Yu ..... A41D 3/00 2/108
2014/0196196 A1 * 7/2014 Lee ..... A41F 7/00 2/400
2014/0310855 A1 * 10/2014 Clifton, Jr. ..... F41C 33/046 2/338
2015/0181953 A1 * 7/2015 Brown ..... A41D 11/00 2/69
2018/0042309 A1 * 2/2018 Brennan ..... A41D 27/28
2020/0268082 A1 * 8/2020 Stevens ..... A41D 27/00
2021/0022423 A1 * 1/2021 Cox ..... A41F 9/02
2021/0401650 A1 * 12/2021 Thompson ..... A41F 9/005
2022/0047002 A1 * 2/2022 Barnes ..... A41D 1/02
2024/0188646 A1 * 6/2024 Wren ..... A41B 9/001

* cited by examiner

RECESSED BELT LOOP

BACKGROUND

Various garments, such as pants, shorts, jeans, skirts, blouses, trench coats and the like, often include belt loops for guiding and retaining a belt as part of the garment.

Figure 1:
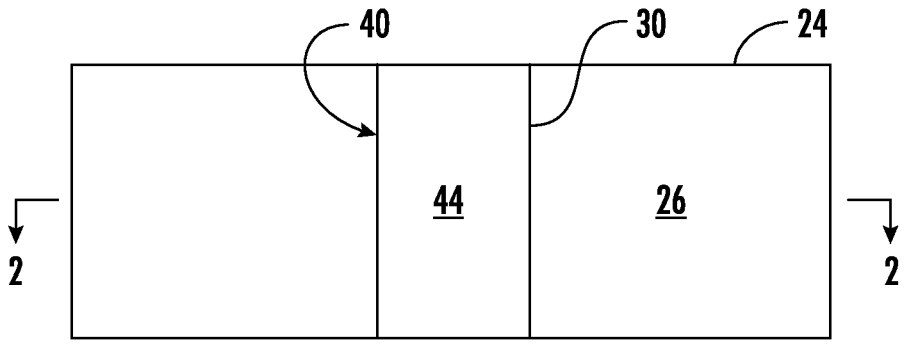
FIG. 1 is a top view of a portion of an example garment having a channel at least partially receiving an example belt loop.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are examples of garments that include a channel for receiving a belt loop when the belt loop is not being utilized. As a result, the unused belt loop may be less conspicuous. Moreover, because the belt loop is at least partially recessed within the channel, the outer surface of the garment is smoother, and the belt loop is less likely to catch on exterior structures.

In some implementations, the channel has a floor, wherein the belt loop extends along and in contact with the floor. In some implementations, the channel has a depth, wherein the belt loop has a thickness less than or equal to the depth. In some implementations, the thickness is equal to the depth. In some implementations, the belt loop has first and second ends secured to the garment beneath a floor of the channel.

In some implementations, the belt loop comprises a flat band. In some implementations, the flat band has a width with folded edge portions. In some implementations, the flat band has a width with folded edge portions and a layer of adhesive or laminate layer sandwiched between the folded edge portions and the flat band across a majority of the width of to maintain a flat profile. In some implementations, the belt loop has a circular or oval cross-section. In some implementations, the belt loop is formed from an elastic material. In some implementations, the belt loop, whether a flat band or having a circular or oval cross-section, is formed from an elastic or resiliently stretchable material, wherein the belt loop resiliently stretches when receiving a belt and resiliently returns to a shorter length when not receiving a belt so as to resiliently return to a position recessed within the channel.

In some implementations, the channel is bordered on opposite sides by folded edge portions of a panel or layer of material. In some implementations, the folded edge portions form ramped sides of the channel. In some implementations, the channel is formed by cut edges of a panel or layer of material. The cut edges may be treated to inhibit fraying such as by being sealed, melted/fused, stitched, coated and/or capped.

In some implementations, the floor of the channel is formed by a floor panel. For example, in implementations where the edges of the channel formed by folded edges of a first panel of material, the floor panel may be joined to the inwardly folded portions of the first panel of material. In some implementations, the floor panel is a distinct panel stitched or bonded to the first panel. In some implementations, the floor panel and the first panel are part of a single continuous integral unitary body or panel of material that is folded to form the floor of the channel. Said another way, a single integral unitary panel is folded to form both of the folded edges of the channel and its floor.

In some implementations, the garment comprises pants, shorts, jeans, skirts, trench coats or the like. In some implementations, the garment comprises a plurality of channels and associated belt loops extending parallel to one another along or about a waistline of the garment. In some implementations, the belt loops and channels are arranged so as to extend along vertical parallel axes when the garment is being worn. In some implementations, the belt loops and channels are perpendicular to a horizontal horizon. In some implementations, the belt loops and channels may extend at vertical angles, oblique to a horizontal horizon.

Disclosed are example garments that comprise a body having a channel and belt loop extending along and at least partially recessed within the channel.

For purposes of this disclosure, the term "coupled" shall mean the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate member being attached to one another. Such joining may be permanent in nature or alternatively may be removable or releasable in nature.

For purposes of this disclosure, the phrase "configured to" denotes an actual state of configuration that fundamentally ties the stated function/use to the physical characteristics of the feature proceeding the phrase "configured to." For purposes of this disclosure, the term "releasably" or "removably" with respect to an attachment or coupling of two structures means that the two structures may be repeatedly connected and disconnected to and from one another without material damage to either of the two structures or their functioning.

Figure 2:
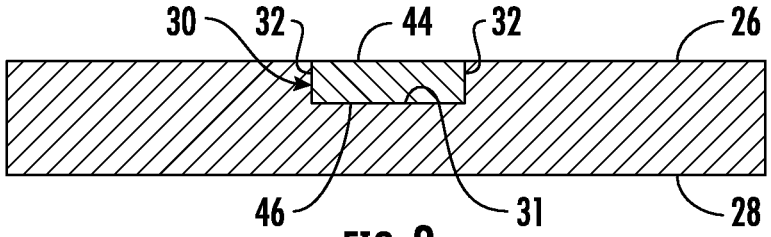
FIG. 2 is a sectional view of the garment of FIG. 1 taken along line 2-2.

FIGS. 1 and 2 schematically illustrate portions of an example garment 20. FIG. 1 is an outer or top view of the portion of garment 20, while FIG. 2 is a sectional view of the portion shown in FIG. 1 taken along line 2-2. Garment 20 may be in the form of pants, shorts, jeans, a skirt, a trench coat or the like. As shown by FIGS. 1 and 2, garment 20 comprises body 24 and belt loop 40.

Body 24 is a portion of garment 20. Body 24 may form a variety of portions of the overall larger garment 20, portions of which are not shown. In some implementations, the portion of body 24 that is shown in FIGS. 1 and 2 comprises a waistband portion of the garment. Body 24, schematically shown in 2, may be comprised of a single layer or panel of material or multiple panels, segments, or layers of a material or materials. The multiple panels or layers of materials may be coextensive or not coextensive. The multiple panels or layers of materials may be formed from a single type of material or from multiple different types of materials. The single panel or the multiple panels may be folded so as to form multiple layers. In some implementations, some of the multiple panels extend completely about the waistline of the person wearing the garment, whereas some panels only partially extend about the waistline of the person wearing the garment 20. Body 24 has an outer surface 26, and an inner surface 28, facing and such or abutting against the person wearing garment 20.

As shown by FIG. 2, body 24 forms or comprises a channel 30. Channel 30 extends into the outer surface 26 and has a depth sized to at least partially receive belt loop 40. In some implementations, channel 30 may comprise a recess extending partially into, but not completely through, a layer of material. In some implementations, channel 30 may comprise an opening that extends completely through a panel or between a pair of opposite panels or panel segments, wherein the panel, at least one of the pair of opposite panels or panel segments, or yet an additional panel, forms a floor of the channel. Channel 30 comprises a floor 31 and sides 32.

Belt loop 40 comprises a length of one or more materials forming a loop sized for receiving a portion of a belt which is to pass between belt loop 40 and channel 30. In some implementations, belt loop 40 is inelastic, but has sufficient length or flexibility so as to be sufficiently withdrawn from channel 30 to receive a belt which would extend beneath belt loop 40, between belt loop 40 and body 24, spanning channel 30. In some implementations, belt loop 40 is resiliently stretchable or elastic, wherein the belt loop 40 resiliently stretches when receiving a belt and resiliently returns to a shorter length when not receiving a belt so as to resiliently return to a position recessed within the channel 30.

As discussed above, belt loop 40 may be one of several belt loops 40 associated with garment 20 for receiving different portions of the same belt. In some implementations, belt loop 40 comprises a single panel of material. In some implementations, belt loop 40 comprise a single panel of material having inwardly folded edges. In some implementations, belt loop 40 may comprise multiple panels joined to one another through adhesive, lamination layers, stitching or the like.

Figure 3:
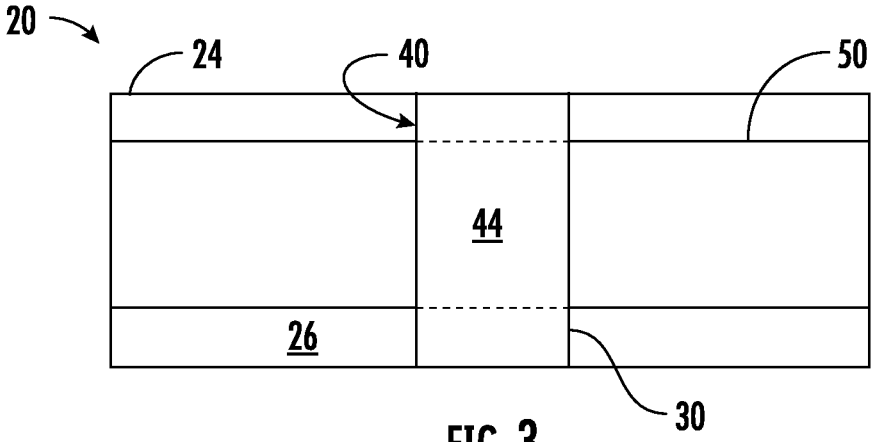
FIG. 3 is a top view of the portion of the example garment shown in FIG. 1 while the example belt loop is receiving and guiding an example belt.
Figure 4:
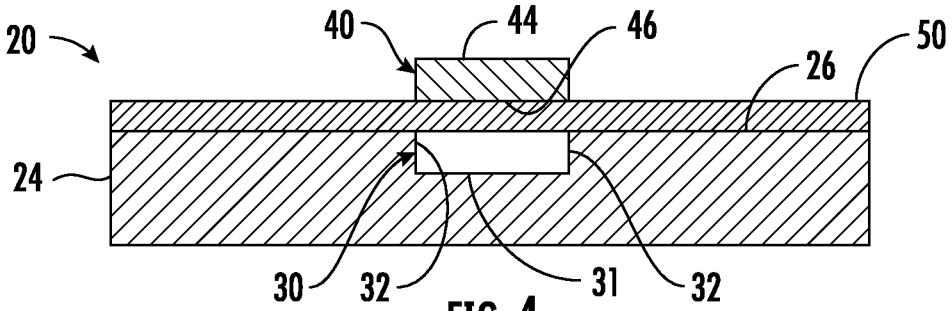
FIG. 4 is a sectional view of the portion of the garment of FIG. 3 while the example belt loop is receiving and guiding the example belt.

FIGS. 1 and 2 illustrate belt loop 40 at least partially received within channel 30 when belt loop 40 is not being used to receive and guide a belt. In such an implementation, garment 20 may not use a belt or the belt may simply extend over and across belt loop 40 while belt loop 40 is received within channel 30. FIGS. 3 and 4 illustrate garment 20 when a belt 50 is provided and when belt loop 40 is used to guide the belt 50. During use of belt 50, belt loop 40 is withdrawn from channel 30 and extends above or away from the top of channel 30 and top surface 26. In some implementations, the material of body 24 and belt loop 40 permit belt loop 40 to be curled out of channel 30 for the reception of belt 50. In some implementations, belt loop 40 is sufficiently elastic so as to be stretchable enough to extend out of channel 30 when receiving belt 50. When belt 50 is being used, belt 50 passes between the belt loop 40, beneath belt loop 40 and the top of channel 30, spanning across and over channel 30. Removal of belt 50 results in belt loop 40 once again returning to a position or state in which at least a portion of belt loop 40 is received within channel 30.

As shown by FIG. 2, in the example illustrated, channel 30 has a depth and belt loop 40 has a thickness or height that the top surface 44 of belt loop 40 lies substantially flush with or level with the outer surface 26 of body 24 when received within channel 30 (when not guiding or receiving a belt 50). In the example illustrated, top surface 44 is flush with outer surface 26 and bottom surface 46 of belt loop 40 abuts or contacts a floor 31 of channel 30. In other implementations, top surface 44 may be flush with exterior surface 26 without bottom surface 46 necessarily contacting or abutting floor 31 of channel 30.

Figure 5:
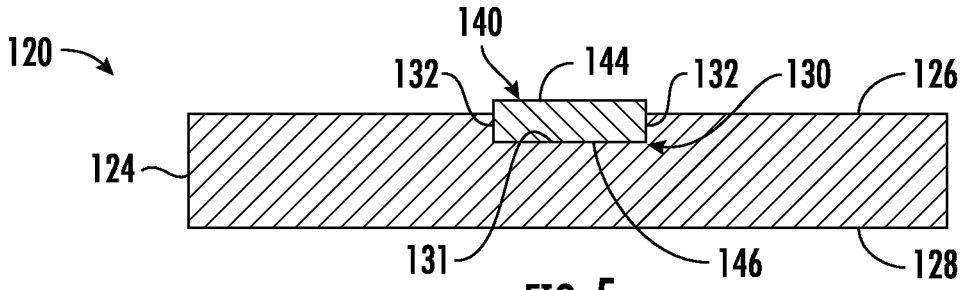
FIG. 5 is a sectional view of an example garment taken along line 2-2 of FIG. 1.
Figure 6:
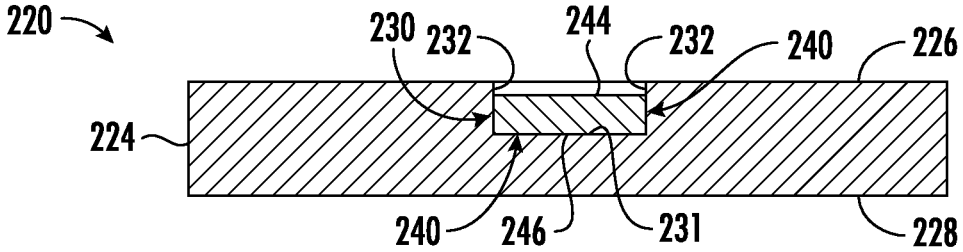
FIG. 6 is a sectional view of an example garment taken along line 2-2 of FIG. 1.

As schematically shown by FIGS. 5 and 6, in some implementations, the top surface of the belt loop may not necessarily extend flush with or level with the outer surface of the body. FIG. 5 illustrates an example garment 120 having a body 124 providing a channel 130 that receives belt loop 140. Channel 130 has floor 131 and opposite side walls 132. Belt loop 140 has a top surface 144 and a bottom surface 146. FIG. 5 illustrates an example where channel 130 is sufficiently shallow and/or where belt loop 140 is sufficiently thick or tall such that top surface 144 of belt loop 140 projects above or beyond top surface 126 of body 124 when belt loop 140 is partially received within channel 130 (when belt loop 140 is not guiding or extending about belt 50). In such an implementation, bottom surface 146 of belt loop 140 may or may not abut or contact floor 131 of channel 130.

FIG. 6 illustrates an example garment 220 having a body 224 providing a channel 230 that receives belt loop 240. Channel 230 has floor 231 and opposite side walls 232. Belt loop 240 has a top surface 244 and a bottom surface 246. FIG. 6 illustrates an example where channel 230 is sufficiently deep and/or where belt loop 240 is sufficiently thin or short such that top surface 144 of belt loop 140 is recessed below top surface 226 of body 224 when belt loop 240 is received within channel 230 (when belt loop 240 is not guiding or extending about belt 50. In such an implementation, bottom surface 246 of belt loop 240 may or may not abut or contact floor 231 of channel 230.

In each of the example shown in FIGS. 1-6, the channels 30, 130, 230 each have a cross-sectional shape corresponding to the cross-sectional shape of their respective belt loops 40, 140, 240. In the examples illustrated, channels 30, 130, 230 are each configured to closely conform to those corresponding portions of the respective belt loop 40, 140, 240 received within channel 30, 130, 230. For example, floor 31 has a flat profile, whereas belt loop 40 has a bottom or inner flat profile. Likewise, sides 32 are generally flat and perpendicular to floor 31, whereas the sides about loop 40 are flat and generally perpendicular to the upper and lower faces of belt loop 40. In the example illustrated, channel 30 is sized such that the bottom or inner surface of belt loop 40 abuts floor 31 when received within channel 30. In the example illustrated, channel 30 is sized such that the interior sides 32 of channel 30 to abut or contact the opposite side surfaces or edges of belt loop 40 when received within channel 30.

In other implementations, the channels 30, 130, 230 may have other sizes. For example, in some implementations, channel 30 has a cross-sectional shape distinct or different from the cross-sectional shape of belt loop 40. In some implementations, the opposite interior sides 32 of channel 30 may be sufficiently spaced from one another such a channel 30 has a width greater than a corresponding with of belt loop 40 such that the opposite sides of belt loop 40 do not contact or abut the interior sides of channel 30. In some implementations, channel 30 has a depth and size or belt loop 40 is connected to body 24 in such a way that the inner or bottom face does not contact or abut floor 31 when received within channel 30.

In each of the examples shown in FIGS. 1-6, belt loops 40, 140 and 240 are each illustrated as a flat band. Belt loops 40, 140 and 240 each have a generally rectangular cross-sectional shape. In each of the above-described examples, garments 20, 120 and 220 may alternatively include a belt loop having other shapes, such as circular or oval cross-sectional shape.

Figure 7:
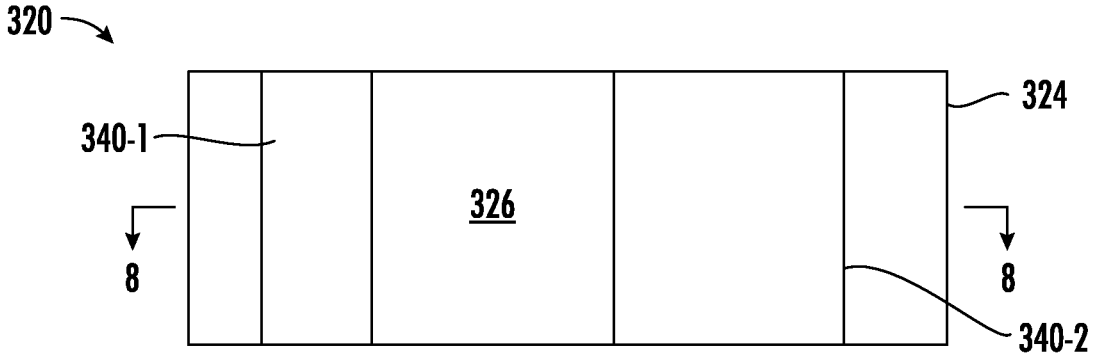
FIG. 7 is a top view of a portion of an example garment having channels at least partially receiving example belt loops.
Figure 8:
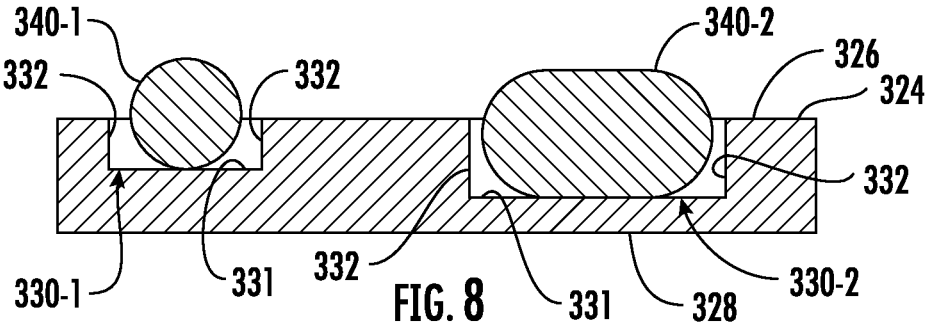
FIG. 8 is a sectional view of the example garment of FIG. 7 taken along line 8-8.

FIGS. 7 and 8 illustrate portions of an example garment 320 having non-rectangular belt loops. Garment 320 comprises body 324 and belt loops 340-1 and 340-2 (collectively referred to as belt loops 340). Body 324 is similar to each of bodies 24, 124 and 224 in that body 324 may form a variety of portions of the overall larger garment 320, portions of which are not shown. In some implementations, the portion of body 324 that is shown in FIG. 7 and comprises a waistband portion of the garment. Body 324, schematically shown in FIGS. 7 and 8, may be comprised of a single layer or panel of material or multiple panels or layers of a material or materials. The multiple panels or layers of materials may be coextensive or not coextensive. The multiple panels or layers of materials may be formed from a single type of material or from multiple different types of materials. The single panel or the multiple panels may be folded so as to form multiple layers. In some implementations, some of the multiple panels extend completely about the waistline of the person wearing the garment, whereas some panels only partially extend about the waistline of the person wearing the garment 320. Body 324 has an outer surface 326, and an inner surface 328, facing and such or abutting against the person wearing garment 320.

As shown by FIG. 8, body 324 forms or comprises channels 330-1 and 330-2 (collectively referred to as channels 330). Channels 330 extend into the outer surface 326 and have a depth sized to at least partially receive belt loops 440. In some implementations, each of channels 330 may comprise a recess extending partially into, but not completely through, a layer of material. In some implementations, each of channels 330 may comprise an opening that extends completely through a panel or between a pair of opposite panels, wherein the panel, at least one of the pair of opposite panels, or yet an additional panel forms a floor of the channel. Each of channels 330 comprises a floor 331 and side walls 332.

Each of belt loops 340 comprises a length of one or more materials forming a loop sized for receiving a portion of a belt which is to pass between the belt loop 340-1, 340-2 and the respective channel 330-1, 330-2. In some implementations, one or both of belt loops 340 may be inelastic but may have a sufficient length or flexibility so as to be sufficiently withdrawn from the respective one of channels 330 to receive a belt which would extend beneath belt loop 340-1, 340-2, between belt loop 340-1, 340-2 and body 324, spanning channels 330-1, 330-2. In some implementations, one or both of belt loops 340 is resiliently stretchable or elastic, wherein the belt loop 340-1, 340-2 resiliently stretches when receiving a belt and resiliently returns to a shorter length when not receiving a belt so as to resiliently return to a position recessed within the respective channel 330-1, 330-2.

In the example illustrated, belt loop 340-1 comprises a tubular or solid cylindrical cord having a circular cross-sectional shape. In the example illustrated, belt loop 340-2 comprises a tubular or solid cord having an oval cross-section shape. In the example illustrated, the corresponding channels 330-1 and 330-2 have different shapes, rectangular cross-sectional shapes, which are sized such that belt loops 340 partially nest or partially received within such channels 330, resulting in the top or upper portions of such belt loops 340 projecting outwardly or above and beyond the top surface 326 of body 324 (similar to channel 130 and belt loop 140).

In other implementations, channels 330 may alternatively have shapes that at least partially correspond to the belt loops that are to be received within such channels when the belt loops 340 are not being employed to receive and guide a belt. For example, channel 330-1 may alternatively have a semi-circular cross-sectional shape to match the rounded outer shape of belt loop 340-1. Channel 330-2 may alternatively have a semi-oval cross-sectional shape to match the semi-oval lower outer shape of belt loop 340-2.

In other implementations, channels 330 and belt loops 340 may have alternate dimensions that result in belt loops 340 having top or upper surfaces that are flush with top surface 326 of body 24 (similar to channel 30 and belt loop 40). In other implementations, channel 330 belt loop 340 may have alternate dimensions that result in belt loops 340 having top or upper surfaces that are recessed within their respective channels 330, below or inside of the body 324 (similar to channel 230 and belt loop 240).

As discussed above, belt loops 340 may be a portion of more than two belt loops 340 associated with garment 320 for receiving different portions of the same belt. In some implementations, each of belt loops 340 comprises a single wound or braided cord of material. In some implementations, each of belt loops 340 may comprise multiple wound or braided layers extending about a hollow interior or an inner core. In some implementations, the core and/or individual layers wrapped or wound about the core may be formed from different materials and have different elastic or inelastic properties.

In the example illustrated, sides 332 of channel 330-1 are spaced apart from one another to provide channel 330-1 with a width that is greater than the diameter of belt loop 340-1. The lower surface of belt 340-1 is connected and/or formed from a material so as to contact floor 331 when received within channel 330-1. In other implementations, the sides 332 of channel 330-1 may contact or more closely conform to the sides of belt loop 340-1. In other implementations, the channel 330-1 may extend below and be spaced from a lower surface of belt loop 340-1 when belt loop 340-1 is received within channel 330-1.

In the example illustrated, sides 332 of channel 330-2 are spaced apart from one another to provide channel 330-2 with a width that is greater than the diameter of belt loop 340-2. The lower surface of belt loop 340-2 is connected and/or is formed from a material so as to not contact floor 331 of channel 330-2 when received within channel 330-2. In other implementations, the sides 332 of channel 330-2 may contact or more closely conform to the sides of belt loop 340-2. In other implementations, the channel 330-2 has a depth so as to contact a lower surface of belt loop 340-1 when belt loop 340-1 is received within channel 330-2.

FIGS. 9-15 illustrate upper portions of an example garment 420. FIGS. 9-15 illustrate a waist or waistband portion of the garment having at least four at least partially parallel and aligned recessed belt loops spaced along the waistband portion of the garment, two of which are shown. Garment 420 may be in the form of pants, shorts, jeans, a skirt, or the like. As shown by FIGS. 9-12, garment 420 comprises body 424 and belt loops 440-1, 440-2 (collectively referred to as belt loops 440).

Body 424 forms waistband portion 500, lower suspended portion 502 and a separation portion 504, shown as a front fly, having a connector 506. Waistband portion 500 comprises that region of garment 420 that is to extend about the waste of the person wearing garment 420. In some implementations, waistband portion 500 is inelastic. In some implementations, waistband portion 500 is elastic.

Lower suspended portion 502 hangs from waistband portion 500. Lower suspended portion 502 may have various configurations depending upon the particular type of garment. For example, lower suspended portion 502 may form a pair of leg sleeves in the case of garment 420 comprising a pants or shorts. Lower suspended portion 502 may comprise a drape as when garment 420 comprises a blouse or skirt. Lower suspended portion may include pockets and may have a single panel or multiple panels of material. Lower suspended portion 502 may be formed from the same material or from different materials as those forming waistband portion 500.

Separation portion 504 forms a break in waistband portion 500 and lower separation portion 502. In the example illustrated, separation portion 504 comprises a fly having a connector 506. Connector 506 may comprise a button, snap or other releasable connection device. In the example illustrated, separation portion 504 may further include a zipper, buttons, or the like (not shown) along the length of the fly for closing the fly. Although illustrated as the located along a front of garment 420, in some implementations, separation portion 504 may extend along a back of garment 420 such as when separation portion 504 comprises zippered junction on the back of a skirt or blouse. In some implementations, separation portion 504 and its connector 506 may be omitted.

Figure 11:
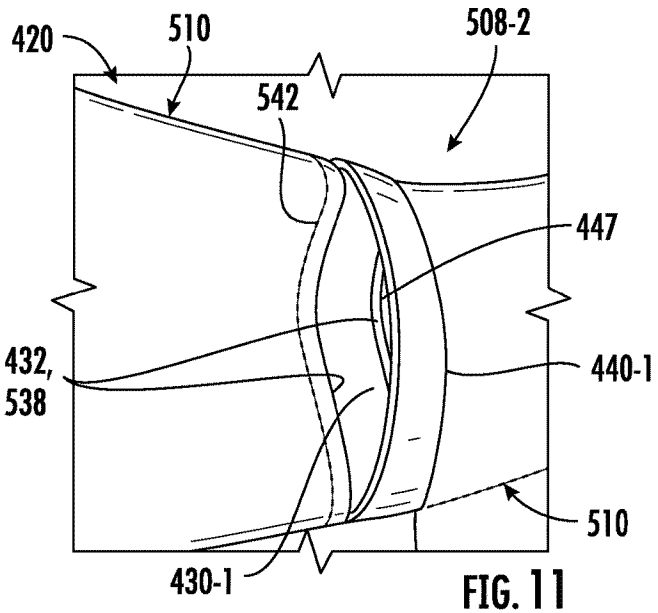
FIG. 11 is an enlarged perspective view of portions of the example garment of FIG. 9 with an example belt loop withdrawn from a corresponding channel in the waistband portion.
Figure 12:
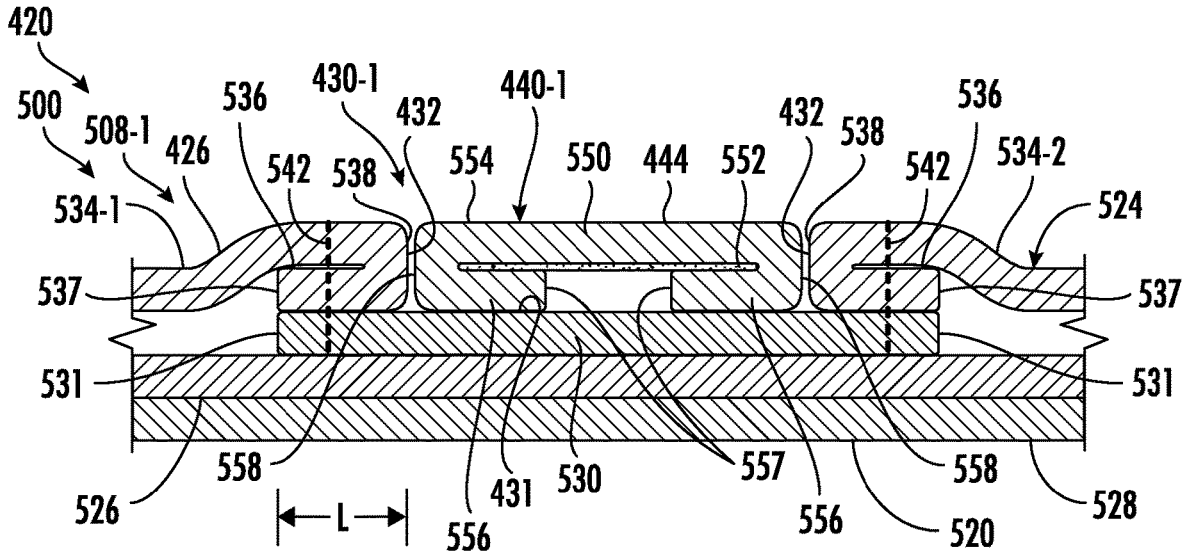
FIG. 12 is a sectional view of portions of the example garment of FIG. 10 taken along line 12-12.

As shown by FIGS. 9-12, waistband portion 500 includes belt loop regions 508-1, 508-2 (collectively to as belt loop regions 508) and intermediate regions 510. Belt loop regions 508 comprise channels for receiving belt loops 440. Intermediate regions 510 comprise non-belt loop regions, extending between belt loop regions 508 or between belt loop regions 508 and separation portion 504. FIG. 12 is a sectional view of belt loop region 508-1 taken along line 12-12 of FIG. 10. Those remaining belt loop regions 508 of waistband portion 500 may have a configuration similar to belt loop region 508-1 shown in FIG. 12. As shown by FIG. 12, belt loop region 508-1 of waistband portion 500 comprises inner panel 520, outer panel 524, intermediate panel 526, and floor panel 530.

Inner panel 520 forms a layer of material that is to extend adjacent to and face the waist of the person wearing garment 420. Inner panel 520 may contact the skin of the person wearing garment 420 or any undergarments worn by the person. Inner panel 520 may extend completely about the waist of the person wearing garment 420. In some implementations, inner panel 520 may comprise a single continuous panel or layer of material having a single break at separation portion 504. In other implementations, inner panel 520 may be formed from multiple segments stitched, fused or otherwise joined, directly or indirectly, to one another. Inner panel 520 may be elastic or inelastic.

Outer panel 524 forms a layer of material that is to be the outermost surface of waistband portion 500, providing a surface that faces away from the waist of the person wearing garment 420. In the example illustrated, outer panel 524 comprises multiple individual segments 534-1, 534-2 (collectively referred to as segments 534), wherein individual segments 534 extend between consecutive belt loop regions 508 or between particular belt loop regions 508 and separation portion 504 (forming intermediate regions 510).

As shown by FIG. 12, consecutive segments 534 of outer panel 524 (segments 524-1 and 534-2 in FIG. 12) have inwardly turned or curled end portions 536. End portions 536 are curled so as to extend away from one another in opposite directions, forming curved or folded edges 538. Edges 538 form the opposite side walls 432 of a channel 430-1 that is configured to receive belt loop 440-1. The folded, doubled thickness of segments 534 may define a depth of the channel 430-1. In some implementations, additional panels or layers may be provided between end portions 536 and the outermost portion of segments 534, wherein such additional layers or panels may increase the thickness of waistband portion 500 about channel 430-1 and possibly increase the depth of channel 430-1.

End portions 536 are maintained a curled or folded state by stitches 542 which extend the outer surface 426, through end portions 536 and through floor panel 530. In other implementations, stitches 542 may additionally extend through intermediate layer 526, without passing through inner panel 520, or additionally through both of intermediate panel 526 an inner panel 520. In other implementations, end portions 536 may be secured and maintained in a folded state by welding/fusing, adhesives and the like.

In the example illustrated, end portions 536 have terminal ends 537 proximate to channel 430-1, resulting in end portions 536 having a relatively short length L. Beyond the terminal ends 537, segments 534, forming the outermost surface of waistband portion 500, gradually return to a coplanar state with the layer of material formed by end portions 536, forming a pair of inclined ramped sides 544 on opposite sides of channel 430-1. Although largely imperceptible, such ramped sides at least partially provide channel 430-1 with its depth.

Intermediate panel 526 comprises a panel of material sandwiched between inner panel 520 and outer panel 524. Intermediate panel 526 may provide additional structural integrity to waistband portion 500. In some implementations, intermediate panel 526 may formed from a different material as compared to the materials forming panel 520 and 524. In some implementations, intermediate panel 526 continuously extends from one side of separation portion 504 to the other side of separation portion 504. In those implementations where separation portion 504 is omitted, intermediate panel 526 may form a continuous loop. In yet other implementations, intermediate panel 526 may be comprised of multiple segments joined, directly or indirectly, to one another. In still other implementations, intermediate panel 526 may be omitted or additional panels of material, similar to panel 526, may be sandwiched between panels 520 and 524.

Floor panel 530 comprises a panel of material sandwiched between end portions 536 and inner panel 520. Floor panel 530 forms a layer of material that serves as a floor 431 of channel 430-1. Floor panel 530 covers intermediate panel 526 such that intermediate panel 526 is not exposed. Floor panel 530 is secured to end portions 536 by stitches 542. As noted above, in other implementations, floor panel 530 may be secured to end portions 536 by welding, fusing, adhesives or the like. In the example illustrated, floor panel 530 has a length such that floor panel 530 is largely contained within belt loop region 508-1, not extending continuously about and along waistband portion 500. In some implementations, floor panel 530 has terminal ends 531 which are aligned with the terminal ends 537 of end portions 536. In other implementations, floor panel 530 may alternatively have a greater length, extending beyond ends 537. In some implementations, floor panel 530 may have a length coextensive with the length of inner panel 520 and/or the length of intermediate panel 526. In some implementations, floor panel 530 may be omitted, wherein intermediate panel 526 or inner panel 520 (when intermediate panel 526 not provided) form the floor of channel 430-1.

Floor panel 530 cooperates with the folded or in-turned end portions 536 to form channel 430-1. In the example illustrated, the ramped sides provide channel 430-1 with its depth. The spacing between the folded edges 538 provide channel 430-1 with its width. In the example illustrated, channel 430-1 has a width equal to the width of belt loop 440-1 or has a width that is less than 2 mm greater than the width of belt loop 440-1. As result, spacing between the edge of belt loop 440-1 and the sides of channel 430-1 are less perceptible when belt loop 440-1 is received within channel 430-1. In other implementations, the width of channel 430-1 may be greater than the width of belt loop 440-1.

In the example illustrated, channel 430-1 has a depth equal to the thickness of belt loop 440-1 or a depth that differs from the thickness of belt loop 440-1 by an amount no greater than 2 mm. The outer surface 444 of belt loop 440-1 is substantially level or flush with the outer surface 426 adjacent to channel 430-1 (at the top or peak of the ramped sides 544). As a result, any transition between belt loop 440-1 and the sides of channel 430-1 is less perceptible. In other implementations, the depth of channel 430-1 may be such that belt loop 440-1, when received within channel 430-1, projects above and beyond channel 430-1 (similar to garment 120 described above). In other implementations, the depth of channel 430-1 may be such that belt loop 440-1, when received within channel 430-1, is recessed within channel 430-1, with top surface 444 located below surface 426 (similar to garment 220 described above).

Figure 9:
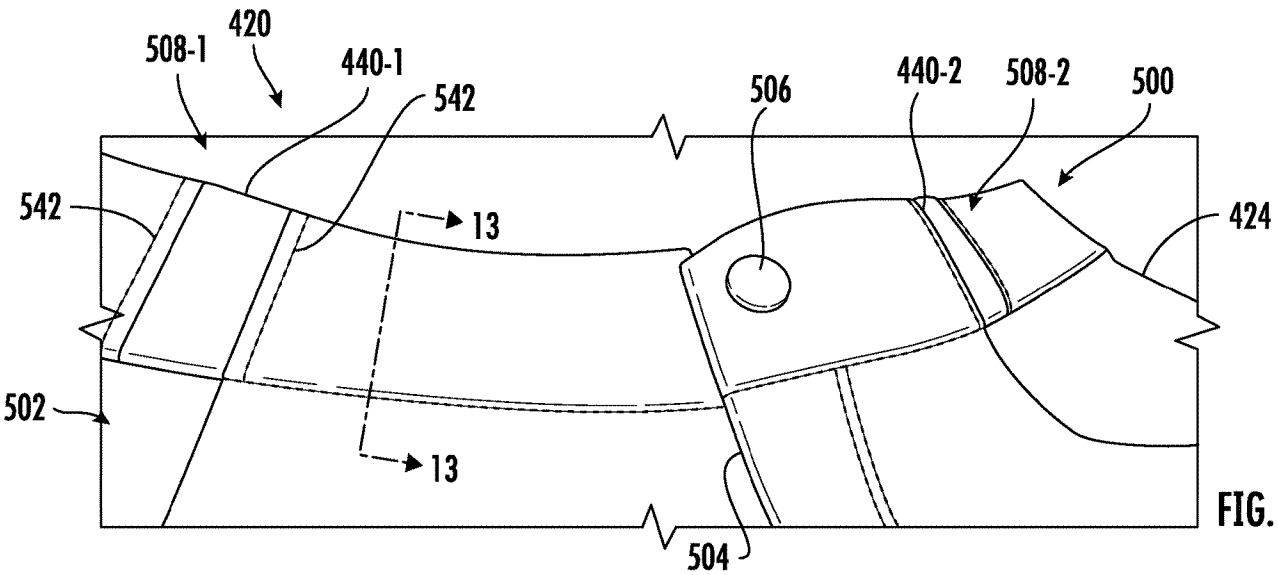
FIG. 9 is a fragmentary perspective view illustrating portions of an example garment having a waistband portion having channels receiving belt loops when the belt loops are not receiving and guiding a belt.
Figure 10:
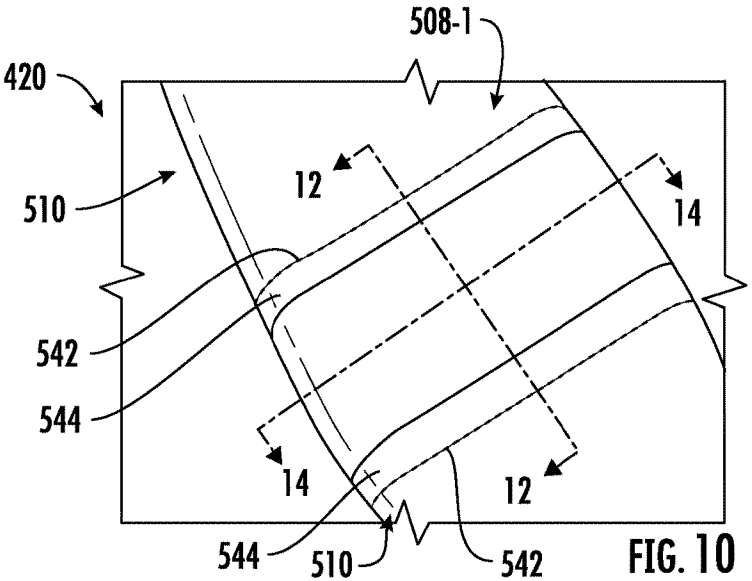
FIG. 10 is an enlarged perspective view of a portion of the example garment of FIG. 9.

As shown by FIGS. 9, 10 and 12, belt loop 440-1 comprises a generally flat band that is at least partially received within channel 430-1 when not receiving a belt and when not guiding a belt along and about waistband portion 500. As shown by FIG. 11, belt loop 440-1 has a sufficient length, is sufficiently flexible and/or is stretchable so as to be withdrawable from channel 430-1 to form a belt passage 447 sized to receive a belt. In some implementations, passage 447 has a vertical length, corresponding to the width (or height) of waistband portion 500, of at least 0.5 inch and a height (the spacing between the peaks of ramped sides 544 (shown in FIG. 10) and the bottom or interior surface of belt loop 440-1) of at least 0.3 inch. In other implementations, belt loop 440-1 may be configured to form a belt passage 447 of different dimensions.

As shown by FIG. 12, belt loop 440-1 comprises panel 550 and adhesive layer 552. Panel 550 comprises an outer portion 554, which forms a top surface 444 of belt loop 440-1, inwardly turned or folded end portions 556 and folded edges 558. In the example illustrated, end portions 556 have terminal ends 557 which are spaced. In other implementations, terminal ends 557 may abut one another, may overlap one another. End portions 556 and outer portion 554 provide belt loop 440-1 with the thickness corresponding to twice the thickness of panel 550 which, in the example illustrated, corresponds to the maximum thickness of ramped portions or sides 544 (shown in FIG. 10) on either side of channel 430-1. As discussed above, in other implementations, the overall depth of channel 430-1 and/or the overall thickness of belt loop 440-1

Folded edges 558 form the lateral sides of belt loop 440-1. Folded edges 558 provide belt loop 440-1 with a smooth or robust edge that is difficult to fray. Folded edges 558 are spaced to provide belt loop 440-1 with its width which, as discussed above, may be equal to or less than the width of channel 430-1.

Adhesive layer 552 is sandwiched between outer portion 554 and folded end portions 556. Adhesive layer 552 adheres outer portion 554 to folded end portions 556. Adhesive layer 552 extends across a majority or at least 75% of the distance between the interior sides of folded edges 558. Adhesive layer 552 maintains the generally rectangular cross-sectional shape or flat profile of belt loop 440-1. In some implementations, adhesive layer 552 may comprise a layer of adhesive material.

In other implementations, adhesive layer 552 may be omitted. In some implementations, outer portion 554 may be secured to folded end portions 556 in other fashions to maintain the flat profile of belt loop 440-1. For example, outer portion 554 may be secured to end portions 556 by stitching, welding or fusing. In some implementations, the surfaces of panel 550 may include a thermoset material or a melted material that may be activated or melted to secure outer portion 554 to end portions 556.

In yet other implementations, belt loop 440-1 may alternatively comprise an additional panel or layer of material that is sandwiched between outer portion 554 and end portions 556. The additional panel of material may provide belt loop 440-1 with a greater thickness and, in some implementations, greater rigidity. In some implementations, the additional panel of material may have two sides which are both coated with an adhesive. In some implementations, the additional panel of material may be formed from a thermoset material that may be activated to adhere outer portion 554 to end portions 556. In some implementations, the additional panel of material may be formed from a meltable or thermoplastic material that may be melted to fuse or join outer portion 554 to end portions 556.

In yet other implementations, belt loop 440-1 may omit the inwardly folded edges or ends, wherein belt loop 440-1 is formed from a single panel of material having edges that are fused, coated, sealed, capped, or otherwise treated to inhibit fraying. In some implementations, belt loop 440-1 may be formed from multiple panels of material that are fused, bonded or stitched to one another to provide belt loop 440-1 with its thickness and flat profile.

Figure 13:
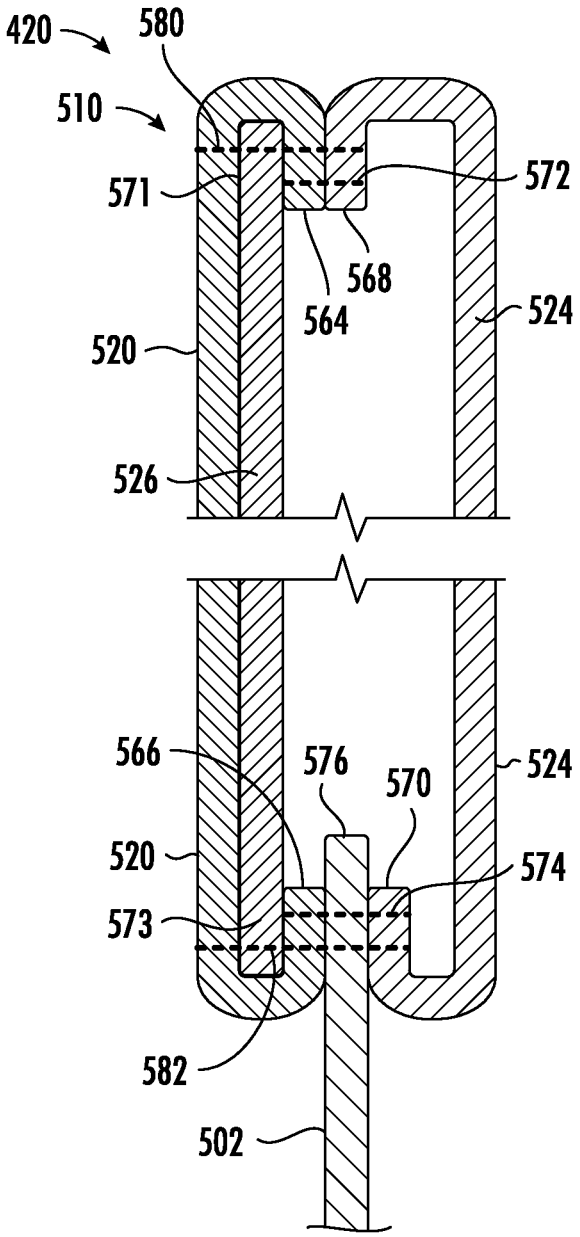
FIG. 13 is a sectional view of portions of the example garment of FIG. 9 taken along line 13-13.
Figure 14:
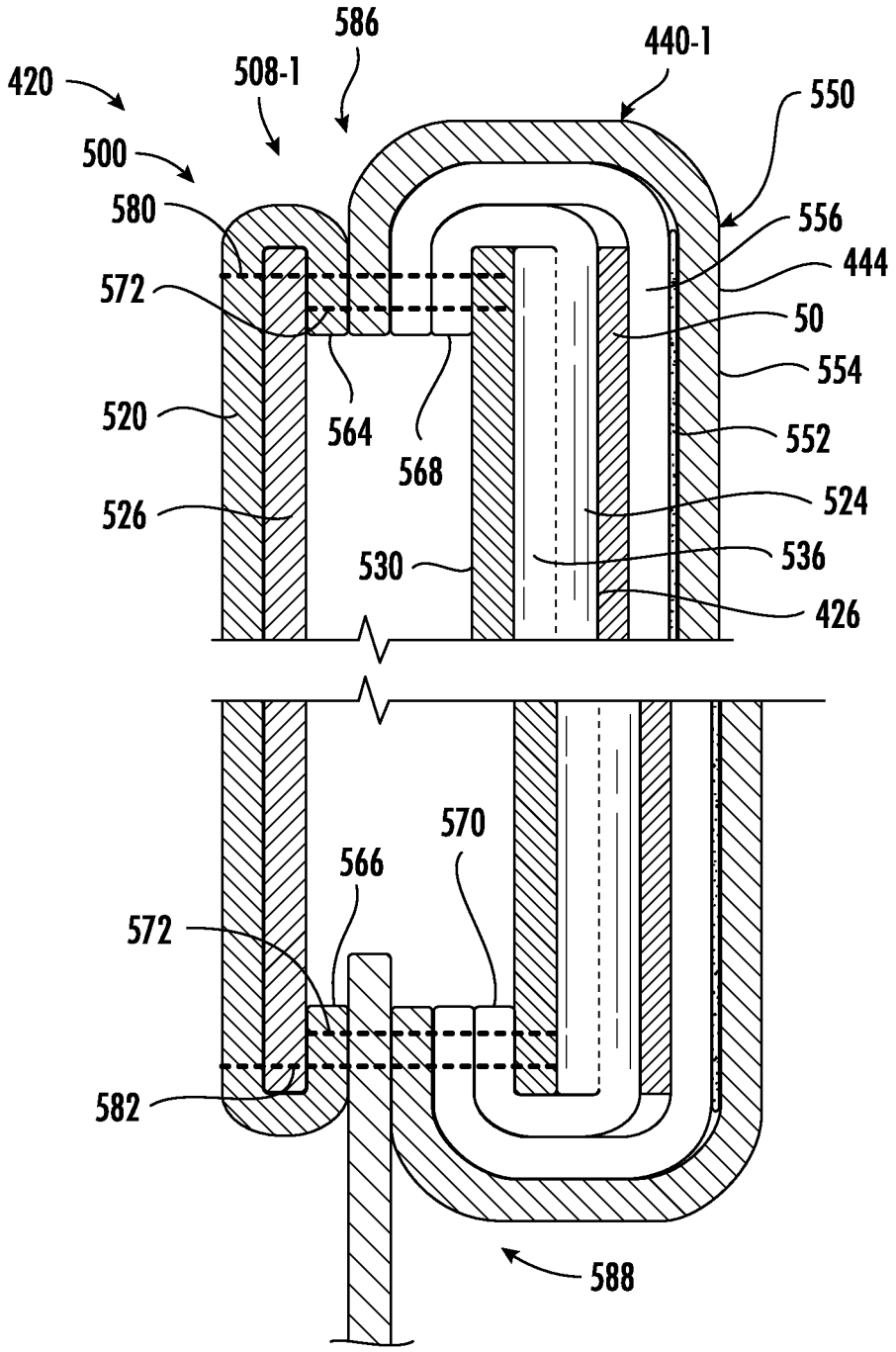
FIG. 14 is a sectional view of the example garment of FIG. 10 taken along line 14-14.

FIGS. 13 and 14 are sectional views that illustrate upper and lower portions of waistband portion 500 of garment 420. FIG. 13 is a sectional view taken along line 13-13 of FIG. 9. FIG. 13 illustrates intermediate region 510 of waistband portion 500. As shown by FIG. 13, inner panel 520 comprises upper in turned end portion 564 and lower in turned end portion 566. Similarly outer panel 524 comprises upper in turned end portion 568 and lower in turned end portion 570. Intermediate panel 526 has upper end portion 571 and lower end portion 573 extending within the fold formed by end portion 564, 566. In the example illustrated, upper stitch 572 extends through and secures end portions 564 and 568 to one another. Lower stitch 574 extends through end portions 566 and 570, securing end portions 566 and 570 to one another.

In the example illustrated, garment 420 further comprises an upper stitch 580 that extends through end portions 564, 568 as well as intermediate panel 526 and exterior portions of panel 520, securing end portions 564, 568 and intermediate panel 526 to one another. Likewise, garment 420 comprises a lower stitch 582 that extends through end portions 566, 570 as well as intermediate panel 526, upper portion 576 of lower suspended portion 502, and exterior portions of panel 520, securing end portions 564, 568, intermediate panel 526, and lower suspended portion 502 to one another. In other implementations, a greater or fewer number of such stitches may be employed. In still other implementations, such end portions, intermediate panel 526 (when provided) and lower suspended portion 502 may be secured to one another in other fashions such as by welding, fusing, adhesives and the like.

Figure 15:
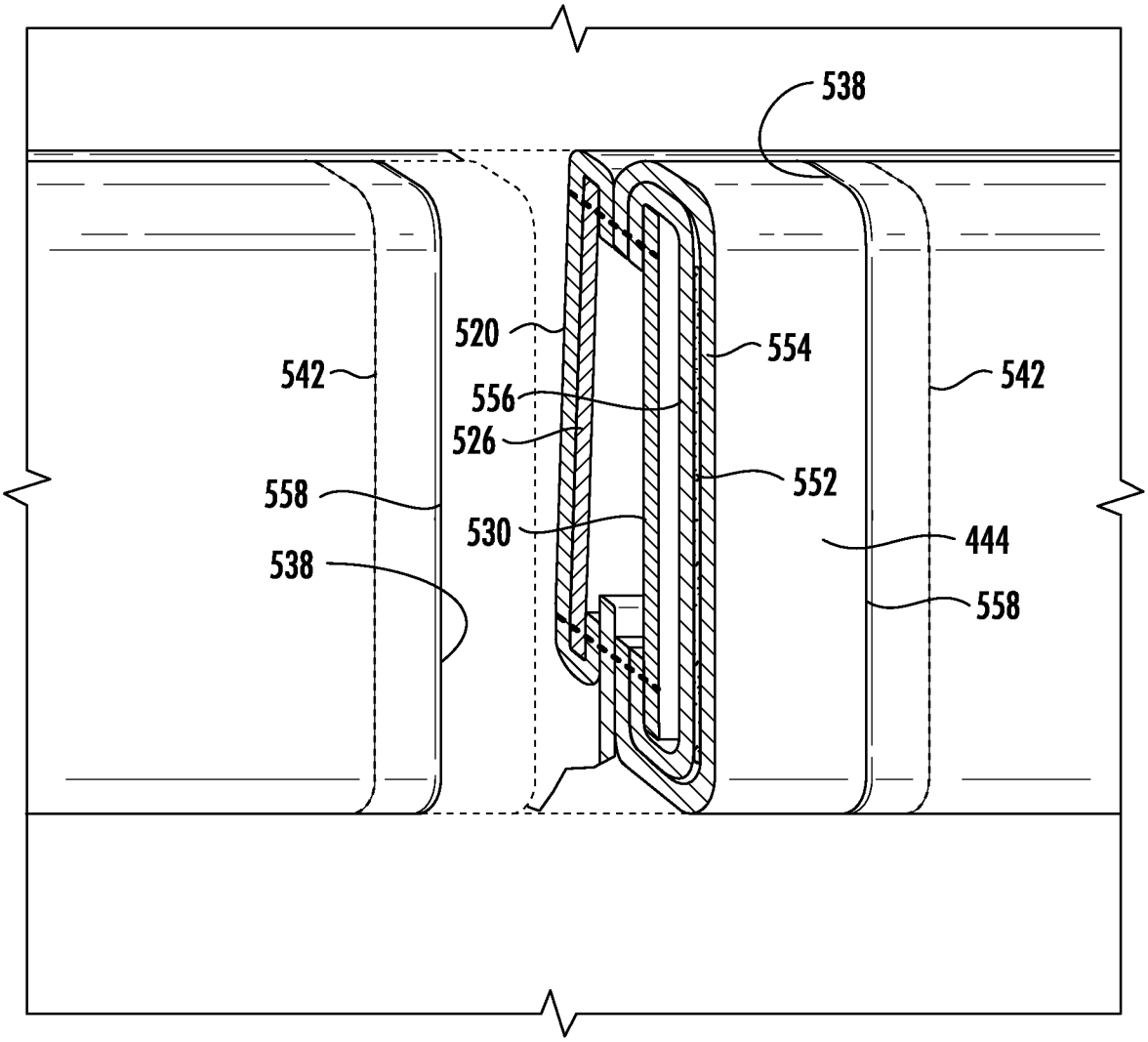
FIG. 15 is a perspective view of the example garment of FIG. 10 illustrating portions of a belt loop region in section and received within a channel.

FIGS. 14 and 15 illustrate upper and lower portions of belt loop region 508-1 of waistband portion 500. FIG. 14 is a sectional view of belt loop region 508-1 with a received belt 50 (schematically illustrated). FIG. 15 is a perspective view illustrating portions of belt loop region 508-1 in section and received within channel 430-1. As shown by such figures, the upper portion 586 of belt loop 440-1 wraps over outer panel 524 and extends between end portions 564 and 568. In the example illustrated, upper portion 586 and lower portion 588 of belt 440-1 extend below floor panel 530 and below floor 431 of channel 430-1. Both of stitches 572 and 580 additionally pass-through upper portion 586 to secure upper portion 586 of belt loop 440-1 to waistband portion 500. Likewise, the lower portion 588 of belt loop 440-1 wraps over outer panel 524 and extends between end portions 566 and 570. Both of stitches 574 and 582 additionally pass-through lower portion 588 to secure lower portion 588 of belt loop 440-1 to waistband portion 500.

Although FIGS. 12-15 illustrate belt loop region 508-1, channel 430-1 and its belt loop 440-1, it should be appreciated that each of the remaining belt loop regions of waistband portion 500 of garment 420 may have similar configurations. In other implementations, some of the other of waistband regions 508 of waistband portion 500 may have different configurations.

FIGS. 16-20 illustrate various other configurations for belt loop region 508-1 as well as the other belt loop regions 508 of waistband portion 500. Although each of such figures illustrates a belt loop received within a channel when the belt loop is not guiding a belt, wherein a top of the belt loop is substantially flush or level with a top of the channel, in other implementations, each of such belt loop regions may alternatively be configured such that the belt loop projects above and beyond of the channel (similar to garment 120) or is recessed within the channel reference similar to garment 220). FIGS. 16-20 are each sectional views that would be taken along line 12-12 of FIG. 10.

Figure 16:
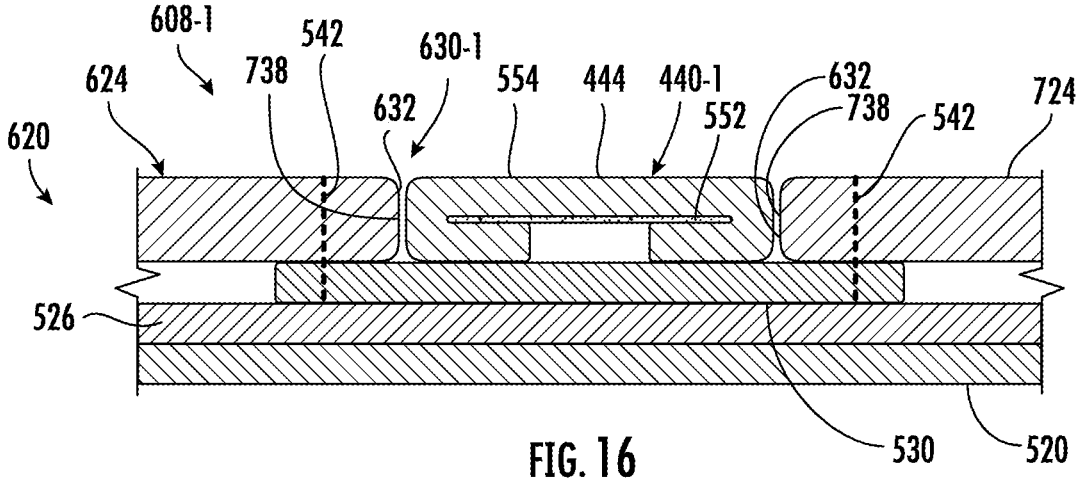
FIG. 16 is a sectional view illustrating portions of an example garment taken along line 12-12 of FIG. 10.

FIG. 16 is a sectional view illustrating portions of an example garment 620 having depicted belt loop region 608-1. FIG. 16 illustrates an example of how a channel for receiving a belt loop may be formed by an unfolded outer panel. Garment 620 is similar to garment 420 described above except that garment 620 comprises a body 624 having an outer panel 724 in place of outer panel 524. Outer panel 724 omits in turned or folded end portions 536 (shown in FIG. 12). Those remaining components of garment 620 which correspond to components of garment 420 are numbered similarly.

In the example illustrated, the thickness of outer panel 724 of garment 620 may define the depth of channel 630-1 which receives belt loop 440-1. The opposite edges 738 of panel 724 form the side edges 632 of channel 630-1. In some implementations, the opposite edges 738 of panel 724 (which may be formed by multiple separate panel segments) may be burnished, fused, coded, sealed or otherwise treated to strengthen such edges or in to inhibit fraying of such edges. In the example illustrated, stitches 542 extend through panel 724 and through floor panel 530. In such an implementation, those portions of outer panel 724 proximate to channel 630-1 may be more level (omitting ramped sides 544).

Figure 17:
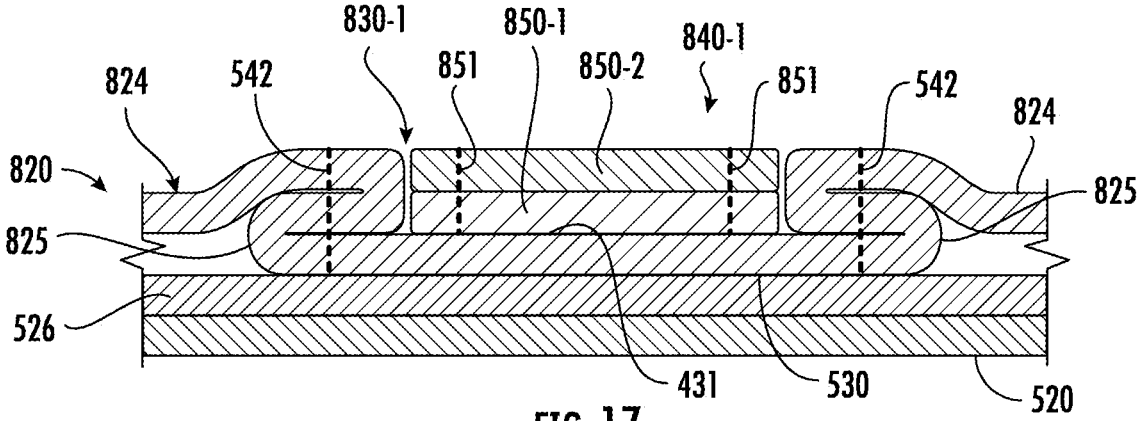
FIG. 17 is a sectional view illustrating portions of an example garment taken along line 12-12 of FIG. 10.

FIG. 17 is a sectional view illustrating portions of an example garment 820. FIG. 17 illustrates an example of how the outer panel of the waistband portion may be folded to form a floor panel and the floor of the channel that receives belt loop. FIG. 17 further illustrates an alternative configuration for the belt loop that is received within the channel. Garment 820 is similar to garment 420 except that garment 820 comprises a body 824 having an outer panel 524 that comprises folded portions 825 which permit the panel of material forming outer panel 524 to also form floor panel 530 and the floor 431 of channel 830-1. Those remaining components of garment 820 which correspond to components of garment 420, described above, are numbered similarly.

Belt loop 840-1 is similar to belt loop 440-1 except that belt loop 840-1 comprises multiple panels, in the form of bands 850-1 and 850-2 (collectively referred to as bands 850) which are joined to one another. In some implementations, bands 850 are stitched to one another via stitches 851. In other implementations, bands 850 may be joined by laminates, welds, fusing, adhesives or the like. In some implementations, bands 850 may be formed from different materials or have different properties. For example, one of bands 850 may have an enhanced stiffness relative to the other of bands 850 or one of bands 850 may have a greater degree of durability or toughness. In some implementations, one or both of bands 850 may have edges that are melted or fused, coated, capped, or otherwise treated to inhibit fraying or wear of such side edges.

Figure 18:
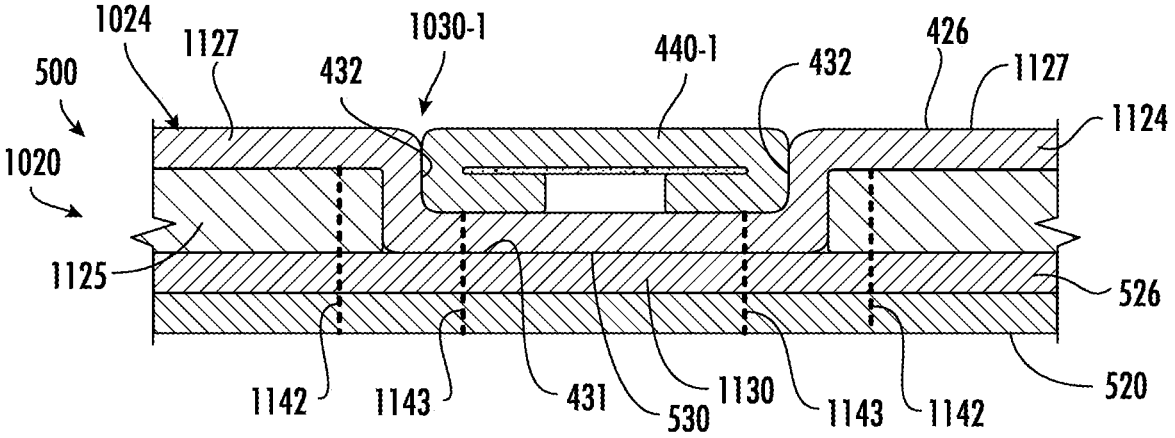
FIG. 18 is a sectional view illustrating portions of an example garment taken along line 12-12 of FIG. 10.

FIG. 18 is a sectional view illustrate portions of an example garment 1020. FIG. 18 illustrates an example of how an additional panel may be provided and how the outer panel of a waistband portion may be folded to form a channel for receiving a belt loop, such as belt loop 440-1 or belt loop 840-1. Garment 1020 is similar to garment 420 described above except that garment 1020 comprises a body 1024 having an outer panel 1124 and supplemental panel 1125. Those remaining components of garment 1020 which correspond to components of garment 420 are numbered similarly and/or are shown and described above with respect to garment 420.

Outer panel 1124 is similar to outer panel 524 except that outer panel 1124 omits in turned end portions 537 (shown in FIG. 12) and instead continuously extends across channel 1030-1 to form floor panel 1130 which forms a floor 431 of channel 1030-1. Outer panel 1124 is bent such that the single continuous outer panel 1124 comprises outer most surfaces 1127 on both sides of channel 1030-1, the interior sides 432 of channel 1030-1 and the floor 431 of channel 1030-1. In such a manner, a single integrally formed panel may continuously extend, without breaks or interruption, from one side of channel 1030-1 to another side of channel 1030-1 while forming the floor 431 and the sides 432 of the channel 1030-1.

Supplemental panel 1025 comprises a panel of material sandwiched between the outer most surfaces 1042 of panel 1124 and inner panel 520. In the example illustrated, supplemental panel 1125 is sandwiched between intermediate panel 526 and the outer most surfaces 1127 of panel 1124. Supplemental panel 1125 assists in maintaining the bends of outer panel 1124 and assists in defining a depth of channel 1030-1. In some implementations, supplemental panel 1125 continuously extends around the waist of the person wearing garment 1120. In other implementations, supplemental panel 1125 may provide by multiple individual sections or segments.

In the example illustrated, the shape of channel 1030-1 is further maintained by at least stitches 1142 and 1143. Stitches 1142 extend through supplemental panel 1125, intermediate panel 526 and inner panel 520 on opposite sides of channel 1030-1 to secure such panels together. Stitches 1143 extend through floor panel 1130 and inner panel 520 proximate to the interior sides 432 of channel 1030-1. In the example illustrated, stitches 1143 extend through floor panel 1130 (formed by outer panel 1124), intermediate panel 526 and inner panel 520 at locations proximate to the opposite interior sides 432 of channel 1030-1. In other implementations, those connections provided by stitches 1142, 1143 may be provided by other mechanisms such as by welds, laminations, adhesives and the like.

Figure 19:
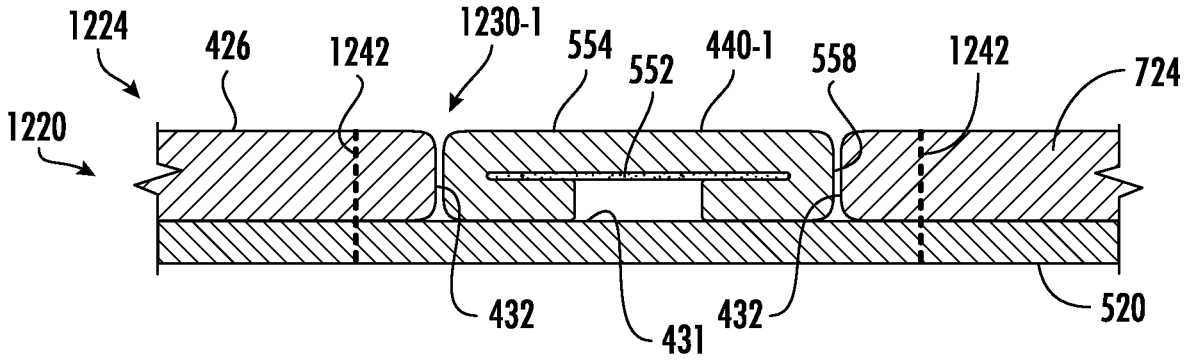
FIG. 19 is a sectional view illustrating portions of an example garment taken along line 12-12 of FIG. 10.

FIG. 19 is a sectional view illustrating portions of an example garment 1220. FIG. 19 illustrates an example of how intermediate panel 526 may be omitted. Garment 1220 is similar to garment 620 described above except that garment 1220 has a body 1224 that omits floor panel 530 and intermediate panel 526. Those remaining components of garment 1220 which correspond to components of garment 620 and such or garment 420 are numbered similarly and such are shown and described above with respect to garments 420 and 620.

With the omission of intermediate panel 526 and floor panel 530, inner panel 520 forms the floor 431 of channel 1230-1. Garment 1220 utilizes stitches 1242 which extend through outer panel 724 and inner panel 520 to secure such panels together. In other implementations, outer panel 724 may be secured or joined to inner panel 520 by welds, fusing, adhesives or the like. Although garment 1220 is illustrated as comprising belt loop 440-1, in other implementations, garment 1220 may include other forms of a belt loop, such as belt loop 840-1.

Figure 20:
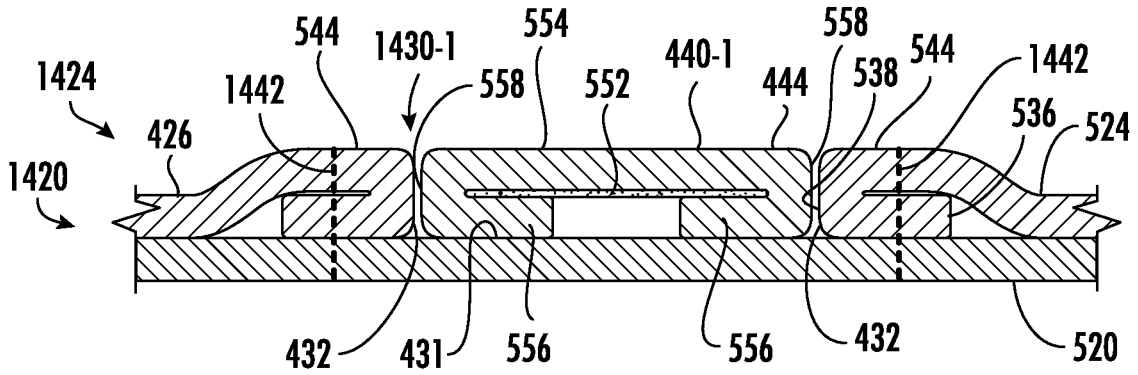
FIG. 20 is a sectional view illustrating portions of an example garment taken along line 20-20 of FIG. 10.

FIG. 20 is a sectional view of portions of an example garment 1420. FIG. 20 illustrates an example of how intermediate panel 526 and floor panel 530 may be omitted and how the outer panel may be folded to form a channel 1430-14 receiving a belt loop, such as belt loop 440-1, when belt loop 440-1 is not being employed to receive or guide a belt. Garment 1420 is similar to garment 420 described above except that garment 1420 has a body 1424 that omits intermediate panel 526 and floor panel 530. Those remaining components of garment 1420 which correspond to components of garment 420 are numbered similarly and/or are shown and described above with respect to garment 420.

With the omission of intermediate panel 526 and floor panel 530, inner panel 520 forms the floor 431 of channel 1430-1. Garment 1420 utilizes stitches 1442 which extend through outer panel 524 and inner panel 520 to secure such panels together. Although garment 1420 is illustrated as comprising belt loop 440-1, in other implementations, garment 1420 may include other forms of a belt loop, such as belt loop 840-1.

Figure 21:
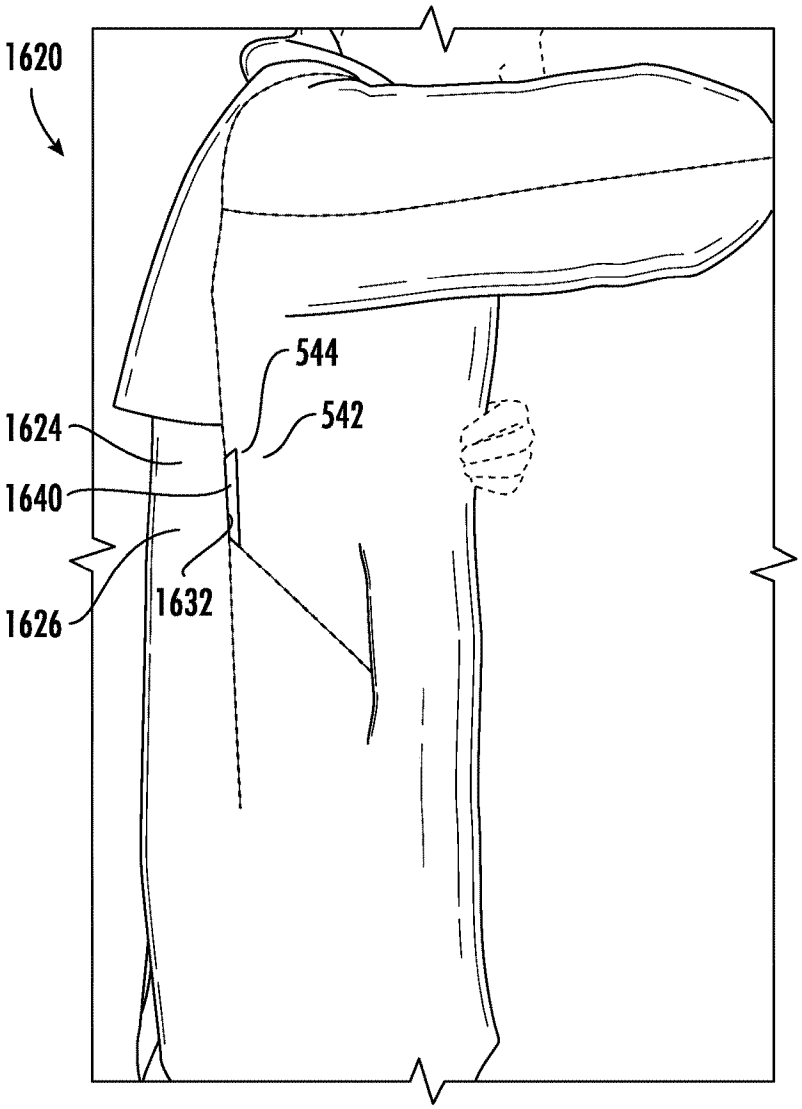
FIG. 21 is a perspective view of an example garment, in the form of a trench coat, having channels that receive corresponding belt loops when the belt loops are not receiving and guiding a belt.
Figure 24:
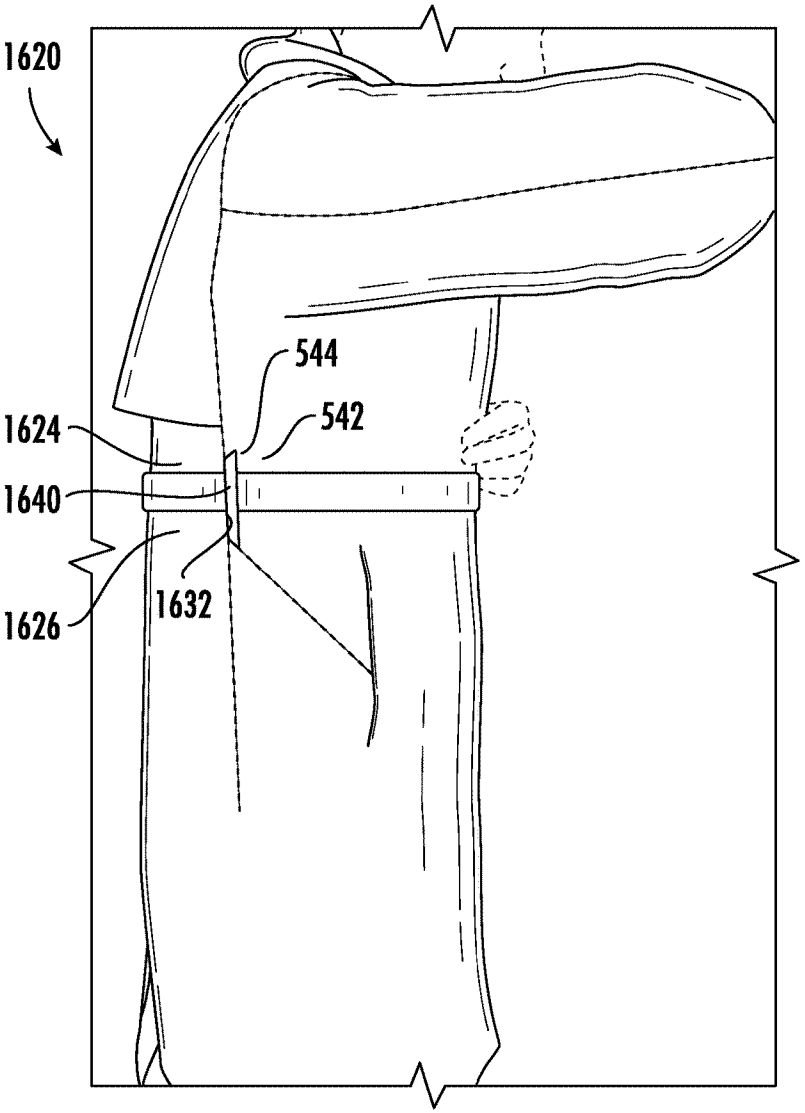
FIG. 24 is a perspective view illustrating the example garment of FIG. 21 with the belt loops receiving and guiding a belt.

FIGS. 21-24 illustrate portions of an example garment 1620 in the form of a trench coat. Similar to the above describe garments, garment 1620 comprises multiple vertically oriented and horizontally aligned, spaced belt loops that are at least partially received within corresponding channels when such belt loops are not receiving or guiding a belt. FIG. 21 illustrates the example garment 1620 when not utilized with a belt. FIG. 24 illustrates the same example garment 620 with the belt loops receiving and guiding a belt 50.

Figure 22:
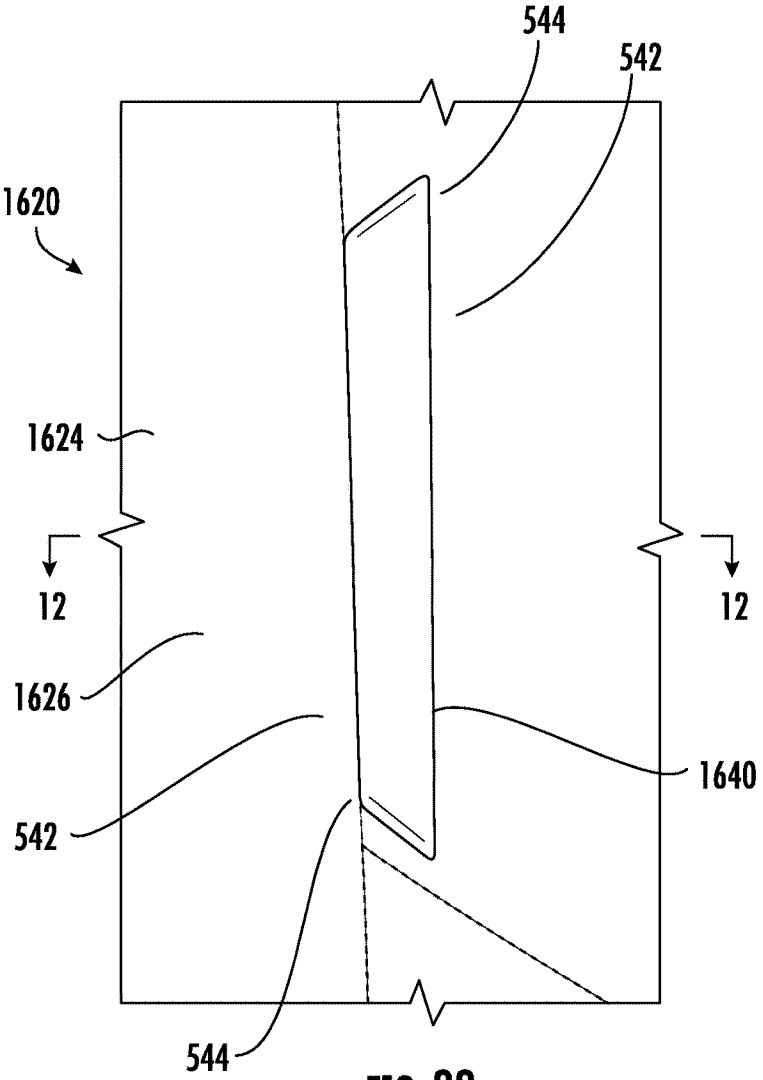
FIG. 22 is an enlarged view of a portion of the example garment of FIG. 21.
Figure 23:
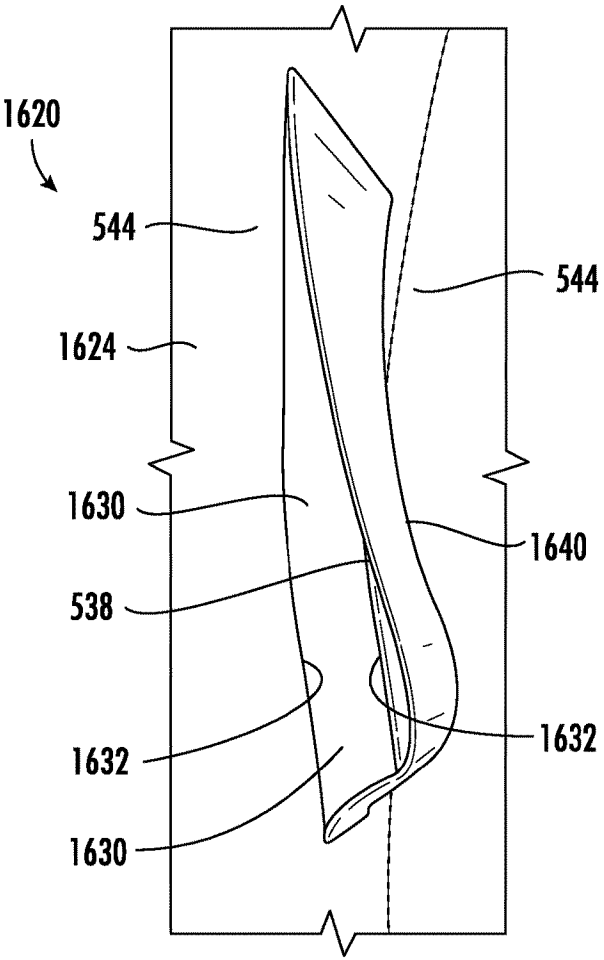
FIG. 23 is an enlarged view of a portion of the example garment of FIG. 21 with the example belt loop withdrawn from the corresponding channel.

FIG. 22 is an enlarged view of a portion of the garment 1620 of FIG. 21. As shown by FIG. 22, garment 1620 comprises body 1624 and belt loop 1640. FIG. 23 illustrates the same portion of garment 1620, but with the belt loop 1640 bent or withdrawn from an underlying channel 1630, ready to receive belt 50.

In the example illustrated, garment 1620 may have a cross-section taken along line 12 that is similar to that shown in FIG. 12. Body 1624 may form a variety of portions of the overall larger garment 1620, portions of which are not shown. In some implementations, the portion of body 1624 that is shown forms a waistband portion of the garment 1620. Body 1624 may be comprised of a single layer or panel of material or multiple panels or layers of a material or materials. The multiple panels or layers of materials may be coextensive or not coextensive. The multiple panels or layers of materials may be formed from a single type of material or from multiple different types of materials. The single panel or the multiple panels may be folded so as to form multiple layers. In some implementations, some of the multiple panels extend completely about the waistline of the person wearing the garment, whereas some panels only partially extend about the waistline of the person wearing the garment 1620. Body 1624 has an outer surface 1626, and an inner surface 528 (shown in FIG. 12), facing and such or abutting against the person wearing garment 1620.

As shown by FIGS. 12 and 23, body 1624 forms or comprises a channel 1630 (similar to channel 430-1 discussed above). Channel 1630 extends into the outer surface 1626 and has a depth sized to at least partially receive belt loop 40. In some implementations, channel 1630 may comprise a recess extending partially into, but not completely through, a layer of material. In some implementations, channel 1630 may comprise an opening that extends completely through a panel or between a pair of opposite panels, wherein the panel, at least one of the pair of opposite panels, or yet an additional panel forms a floor of the channel. Channel 1630 comprises a floor 1631 and side walls 1632 (similar to floor 431 and sides 432 discussed above).

Belt loop 1640 is similar belt loop 440—and comprises a length of one or more materials forming a loop sized for receiving a portion of a belt which is to pass between belt loop 1640 and channel 1630. In some implementations, belt loop 1640 is inelastic, but has sufficient length or flexibility so as to be sufficiently withdrawn from channel 1630 to receive a belt which would extend beneath belt loop 40, between belt loop 1640 and body 1624, spanning channel 1630. In some implementations, belt loop 1640 is resiliently stretchable or elastic, wherein the belt loop 1640 resiliently stretches when receiving a belt and resiliently returns to a shorter length when not receiving a belt so as to resiliently return to a position recessed within the channel 1630.

In the example illustrated, those portions of garment 1620 in FIG. 21-23 have sent to the same construction along line 12-12 of FIG. 22 as that shown in FIG. 12. In other implementations, body 1624 may have other configurations that form channel 1630. For example, in other implementations, body 1624 may have a configuration similar to that described above with respect to body 624, 824, 1024, 1224, or 1424 as discussed above. Channel 1630 may alternatively have a construction similar to that discussed above with respect to channels 630-1, 830-1, 1030-1, 1230-1 or 1430-1 shown and discussed above with respect to FIGS. 16-20.

As discussed above, belt loop 1640 may be one of several belt loops 1640 associated with garment 1620 for receiving different portions of the same belt. In some implementations, belt loop 1640 has a construction similar to that of belt loop 440-1 described above. In other implementations, belt loop 1640 has a construction similar to that of belt loop 840-1 discussed above. In yet other implementations, belt loop 1640 may comprise a single band of fabric or other material.

Although the present disclosure has been described with reference to example implementations, workers skilled in the art will recognize that changes may be made in form and detail without departing from the scope of the claimed subject matter. For example, although different example implementations may have been described as including features providing benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A garment comprising:
- a body comprising:
  - a waist band portion comprising:
    - a first panel having a first upper in turned end portion and a first lower in turned end portion; and
    - a second panel having a second upper in turned end portion and a second lower in turned end portion, the second panel comprising:
      - a first segment inwardly curled in a first direction to form a first folded edge; and
      - a second segment inwardly curled in a second direction, opposite the first direction, to form a second folded edge, the first folded edge and the second folded edge being spaced by a channel therebetween; and
      - a lower suspended portion hanging from the waist band portion and comprising a third panel having an upper portion sandwiched between the first lower in turned end portion and the second lower in turned end portion;
- a floor panel forming a floor of the channel; and
- a belt loop extending along and at least partially recessed within the channel, the belt loop comprising a fourth panel, the fourth panel comprising:
  - an upper portion wrapping about the floor panel and sandwiched between the first upper in turned end portion and the floor panel; and
  - a lower portion wrapping about the floor panel and sandwiched between the first lower in turned end portion and the floor panel.

2. The garment of claim 1, wherein the belt loop extends along and in contact with the floor.

3. The garment of claim 2, wherein the channel has a depth and wherein the belt loop has a thickness less than or equal to the depth.

4. The garment of claim 3, wherein the belt loop has a thickness equal to the depth.

5. The garment of claim 3, wherein the belt loop comprises a flat band.

6. The garment of claim 3, wherein the belt loop has one of a circular cross-section and an ovular cross-section.

7. The garment of claim 2, wherein the belt loop has first and second ends secured to the body beneath the floor of the channel.

8. The garment of claim 1, wherein the first segment comprises a first ramp proximate the first folded edge and wherein the second segment comprises a second ramp proximate the second folded edge.

9. The garment of claim 1, wherein the second segment is inwardly curled in the second direction to form a third folded edge; and wherein the second panel further comprises:
- a third segment inwardly curled in the first direction to form a fourth folded edge, the third folded edge and the fourth folded edge being spaced by a second channel therebetween, the second channel extending parallel to the first channel, the garment further comprising:
  - a second belt loop extending along and at least partially recessed within the second channel, the second belt loop comprising a fifth panel, the fifth panel comprising:

a second upper portion wrapping about the floor panel and sandwiched between the first upper in turned end portion and the floor panel; and a second lower portion wrapping about the floor panel and sandwiched between the first lower in turned end portion and the floor panel.

10. The garment of claim 9, wherein the floor panel extends beneath the first folded edge and the second folded edge.

11. The garment of claim 10, wherein the floor panel has edges and is distinct from the first panel and the second panel.

12. The garment of claim 10, wherein the first folded edge, the second folded edge and the floor panel are formed from a single continuous unitary panel of material folded to form the first folded edge and the second folded edge.

13. The garment of claim 1, wherein the floor panel extends beneath the first folded edge and the second folded edge.

14. The garment of claim 13, wherein the floor panel has edges and is distinct from the first panel and the second panel.

15. The garment of claim 14, wherein the first panel, the second panel and the floor panel are formed from identical materials.

16. The garment of claim 13, wherein the first folded edge, the second folded edge and the floor panel are formed from a single continuous unitary panel of material folded to form the first folded edge and the second folded edge.

17. The garment of claim 1, wherein the body comprises:

a second channel parallel to and aligned with the channel; and a second belt loop extending along and at least partially recessed within the second channel.

18. The garment of claim 1, wherein the waist band portion further comprises a floor panel extending between the first folded edge and the second folded edge, the floor panel having an upper edge about which the second upper in turned end portion wraps and a lower edge about which the second lower in turned end portion wraps.

19. The garment of claim 1, wherein the waist band portion further comprises an intermediate panel, the intermediate panel having an upper edge about which the first upper in turned and portion wraps and a lower edge about which the first lower in turned end portion wraps.

20. The garment of claim 1, wherein the fourth panel forming the belt loop has a first folded edge with a first folded end portion and a second folded edge with a second folded end portion, the first folded end portion and the second folded end portion being sandwiched between the floor panel and the first lower in turned end portion, and sandwiched between the floor panel and the first upper in turned end portion.

* * * * *